US008285165B2

(12) United States Patent
Hirai

(10) Patent No.: US 8,285,165 B2
(45) Date of Patent: Oct. 9, 2012

(54) TONER CONCENTRATION ADJUSTING SYSTEM AND IMAGE FORMING APPARATUS USING THE SAME

(75) Inventor: Atsuto Hirai, Ikoma (JP)

(73) Assignee: Konica Minolta Holdings, Inc., Tokyo (JP)

( * ) Notice: Subject to any disclaimer, the term of this patent is extended or adjusted under 35 U.S.C. 154(b) by 266 days.

(21) Appl. No.: 12/839,686

(22) Filed: Jul. 20, 2010

(65) Prior Publication Data

US 2011/0020023 A1 Jan. 27, 2011

(30) Foreign Application Priority Data

Jul. 24, 2009 (JP) ..... 2009-172890

(51) Int. Cl.
*G03G 15/10* (2006.01)

(52) U.S. Cl. ..... 399/57

(58) Field of Classification Search ..... 399/57–59, 399/62

See application file for complete search history.

(56) References Cited

U.S. PATENT DOCUMENTS

| | | | | |
|---|---|---|---|---|
| 6,134,394 | A * | 10/2000 | Tsukamoto et al. | 399/30 |
| 7,561,815 | B2 * | 7/2009 | Kamijo et al. | 399/45 |
| 7,764,891 | B2 * | 7/2010 | Du et al. | 399/62 |
| 8,121,504 | B2 * | 2/2012 | Umemoto et al. | 399/58 |

FOREIGN PATENT DOCUMENTS

| | | |
|---|---|---|
| JP | 2008-309845 | 12/2008 |
| JP | 2009-002998 | 1/2009 |
| JP | 2009-069586 | 4/2009 |

* cited by examiner

*Primary Examiner* — David Gray

*Assistant Examiner* — Gregory H Curran

(74) *Attorney, Agent, or Firm* — Brinks Hofer Gilson & Lione

(57) ABSTRACT

The present invention provides a toner concentration adjusting system and an image forming apparatus which can accurately adjust toner concentration by controlling the supply of a concentrated developer even if a production lot of the concentrated developer is different. In the method, for controlling the toner concentration, in which the supply of the concentrated developer and the like to a wet type developer for which a first control target value is set is controlled while detecting a substitute characteristic of toner concentration, the first control target value is corrected depending on a second control target value based on a substitute characteristic of the toner concentration of the lot of the concentrated developer to be supplied, and depending on a cumulative supply amount of the lot of the concentrated developer.

6 Claims, 12 Drawing Sheets

TONER CONCENTRATION ADJUSTING SYSTEM AND IMAGE FORMING APPARATUS USING THE SAME

This application is based on Japanese Patent Application No. 2009-172890 filed on Jul. 24, 2009, in Japanese Patent Office, the entire content of which is hereby incorporated by reference.

TECHNICAL FIELD

The present invention relates to a toner concentration adjusting system which detects a substitute characteristic of toner concentration of a wet type developer containing toner and dispersion medium and adjusts the toner concentration by controlling supply of a concentrated developer containing high toner concentration and dispersion medium, based on comparison of the detected results with a control target value, and an image forming apparatus using the same.

BACKGROUND

An image forming apparatus using an electrophotographic method, in which an electrostatic latent image is formed on a photoconductor (an image carrier), a toner being adhered on the latent image, and is transferred and fixed on paper and the like, is widely utilized. In particular, in an image forming apparatus such as an office printer and an on-demand printing apparatus for large volume printing which requires higher image quality and higher resolution, a wet type developing method utilizing a liquid type developer (also referred to as a wet type developer) which has a smaller toner particle size and hardly causes unevenness of a toner image has been utilized.

In recent years, has been proposed is an image forming apparatus utilizing a wet type developer with high viscosity and high concentration, which is constituted of solid toner including resin and pigment, which toner is dispersed in an insulating liquid "a carrier liquid (also referred to as a dispersing medium)" such as silicone oil at high concentration.

At the time of development by use of a wet type developer, it is general that development is conducted by forming a thin layer on the order of micrometer of a developer on a developer carrier such as a developing roller, and by bringing this developer having been made into a thin layer in contact with a photoconductor having a latent image.

A latent image on the surface of a photoconductor is developed by the thin layer of the wet type developer to form a toner image on the photoconductor surface. This toner image is transferred onto a recording medium. Otherwise, the toner image is once primarily transferred on an intermediate transferring material and then secondarily transferred onto a recording medium.

The toner image having been transferred onto a recording medium is fixed by being pressed or heated by a fixing device on a recording medium which is generally made of paper.

On the other hand, some amount of a wet type developer remains on the surface of the developing roller after development. Since this wet type developer (rich in a carrier component) provides bad influences to the following image formation, it is removed by a cleaning device such as a blade.

A wet type developer having been removed from the developing roller may be generally collected as waste liquid; however, it causes a high environmental load and needs high cost to dispose (including the case of recycling in other places after having been transferred or disposing after having been processed). Therefore, it may often be reused as a recovered developer.

In a development apparatus utilizing a wet type developer, in the case of recovering and reusing a wet type developer having been used in a developing section, the toner concentration of the recovered wet type developer is greatly deviated from the original toner concentration. If the developer is used as it is, it causes a problem of variation of image density.

Therefore, it is general to detect the toner concentration of the wet type developer having been recovered to adjust it.

However, it is difficult to use an optical sensor because of little transmitted light in the case of a wet type developer having high toner concentration while it is possible to directly measure the toner amount by an optical sensor in the case of a wet type developer having low toner concentration.

Therefore, for a wet type developer having high toner concentration, developed has been a technology to calculate toner concentration by measuring viscosity of the wet type developer as a substitute characteristic of the toner concentration (refer to Laid-open Japan Patent Application Publications No. 2008-309845 and No. 2009-2998). As a means to measure viscosity, utilized is a method to measure electric current of a motor required to stir the developer at a predetermined speed.

In Laid-open Japan Patent Application Publication No. 2008-309845, disclosed is a system to determine viscosity as a substitute characteristic of toner concentration by detecting a torque required to rotate a stirring means at a predetermined speed. Thus, toner concentration is detected by calculation based on the torque, temperature and mass of that liquid.

In Laid-open Japan Patent Application Publication No. 2009-2998, also disclosed is a system to determine viscosity as a substitute characteristic of toner concentration by detecting a torque required to rotate a stirring means at a predetermined speed. In that system, included is a technology to maintain a constant amount of a wet type developer by providing a detection tank with an opening through which the developer overflows when the amount becomes a predetermined value.

The viscosity of a wet type developer may be different even if the developer has the same toner concentration, depending on the temperature of the wet type developer and size and form of the toner.

With respect to the influence of temperature of a wet type developer on the viscosity, correction may be conducted by measuring the temperature (Laid-open Japan Patent Application Publication No. 2009-69586).

On the other hand, viscosity of a wet type developer may differ even if it has the same toner concentration when the particle size or form of the toner varies depending on manufacturing lots of the wet type developer. Therefore, there may be caused an issue of deviation of a toner concentration from an target value even if the viscosity of a wet type developer is adjusted to be constant.

Therefore, a mechanism to compensate the deviation has been proposed (refer to Laid-open Japan Patent Application Publication No. 2009-69586).

In Laid-open Japan Patent Application Publication No. 2009-69586, disclosed is a system to determine toner concentration by measuring viscosity. The basic correction table prepared for correction of a target viscosity characteristic depending on temperature is further corrected with respect to each developer to prepare an individual correction table for said developer. Then, adjustment of toner concentration is conducted based on the individual correction table.

As described above, viscosity of a wet type developer measured for adjustment of toner concentration may differ even with the same toner concentration due to influence of temperature of the wet type developer, and of variation in the particle size and form of a toner depending on manufacturing lots and the like.

To overcome this problem, developed was a technology to correct a target value of viscosity in consideration of temperature and manufacturing lots and the like, as described in Laid-open Japan Patent Application Publication No. 2009-69586.

However, in the case of practical toner concentration adjustment of a wet type developer, a wet type developer in use is supplied with another lot of wet type developer, whereby different lots of wet type developers get to be mixed together.

In a technology described in Laid-open Japan Patent Application Publication No. 2009-69586 correction is made only for each lot of wet type developer to set a suitable (viscosity) target value, and therefore that technology cannot be applied to the case of a wet type developer of a different lot being gradually added.

In addition to correction of individual lot, suitable correction of a (viscosity) target value depending on the supply amount of a concentrated developer of a different lot is required.

SUMMARY

In view of forgoing, one embodiment according to one aspect of the present invention is a toner concentration adjusting system, comprising:

a toner concentration adjusting tank configured to store a first wet type developer containing toner and dispersion medium;

a concentration detecting section configured to measure a first control value corresponding to viscosity which is a substitute characteristic of toner concentration of the first wet type developer in the toner concentration adjusting tank;

a concentrated developer supply section configured to supply the toner concentration adjusting tank with a concentrated developer having a toner concentration higher than a predetermined standard toner concentration;

a dispersion medium supply section configured to supply the toner concentration adjusting tank with dispersion medium;

a supply control section configured to control the concentrated developer supply section and the dispersion medium supply section so that the first control value measured by the concentration detecting section gets close to a first control target value corresponding to viscosity which is a substitute characteristic of toner concentration of the wet type developer with the standard toner concentration, the supply control section including:

- a supply amount measuring section configured to measure a cumulative supply amount of the concentrated developer; and
- a control target value correction section configured to correct the first control target value based on a second control target value corresponding to viscosity which is a substitute characteristic of toner concentration of a diluted developer in which the concentrated developer is diluted to the standard toner concentration with the dispersion medium, and based on the cumulative supply amount measured by the supply amount measuring section.

According to another aspect of the present invention, another embodiment is an image forming apparatus, comprising:

an image carrier configured to carry thereon an electrostatic latent image;

a toner concentration adjusting system, the toner concentration adjusting system including:

- a toner concentration adjusting tank configured to store a first wet type developer containing toner and dispersion medium;
- a concentration detecting section configured to measure a first control value corresponding to viscosity which is a substitute characteristic of toner concentration of the first wet type developer in the toner concentration adjusting tank;
- a concentrated developer supply section configured to supply the toner concentration adjusting tank with a concentrated developer having a toner concentration higher than a predetermined standard toner concentration;
- a dispersion medium supply section configured to supply the toner concentration adjusting tank with dispersion medium; and
- a supply control section configured to control the concentrated developer supply section and the dispersion medium supply section so that the first control value measured by the concentration detecting section gets close to a first control target value corresponding to viscosity which is a substitute characteristic of toner concentration of the wet type developer with the standard toner concentration, the supply control section having:
  - a supply amount measuring section configured to measure a cumulative supply amount of the concentrated developer; and
  - a control target value correction section configured to correct the first control target value based on a second control target value corresponding to viscosity which is a substitute characteristic of toner concentration of a diluted developer in which the concentrated developer is diluted to the standard toner concentration with the dispersion medium, and based on the cumulative supply amount measured by the supply amount measuring section; and a wet type development device configured to develop the electrostatic latent image on the image carrier with the wet type developer, containing toner and dispersion medium, supplied from the toner concentration adjusting tank.

DETAILED DESCRIPTION OF THE PREFERRED EMBODIMENT

This embodiment has been conceived in view of the above-described technical problems. An object of this embodiment is to provide a toner concentration adjusting system, in which viscosity is detected as a substitute characteristic of toner concentration of a wet type developer, and the detected value is compared with a control target value to control supply of concentrated developer and the like, whereby toner concentration can be precisely adjusted without being influenced by fluctuation depending on the different in lot of a concentrated developer to be supplied and viscosity variation depending on the supply amount, that is, being influenced by deviation in a detected result of toner concentration, even in the case of a concentrated developer of a different lot being additionally and gradually supplied at the time of adjusting the toner concentration, and productivity is improved because of the increased adjusting width; and also provides an image forming apparatus.

In the following, an embodiment of a toner concentration adjusting system according to the invention and an image forming apparatus equipped with that toner concentration adjusting system will be explained in reference to the drawings.

(Outline Constitution and Operation of Wet Type Image Forming Apparatus)

Figure 1:
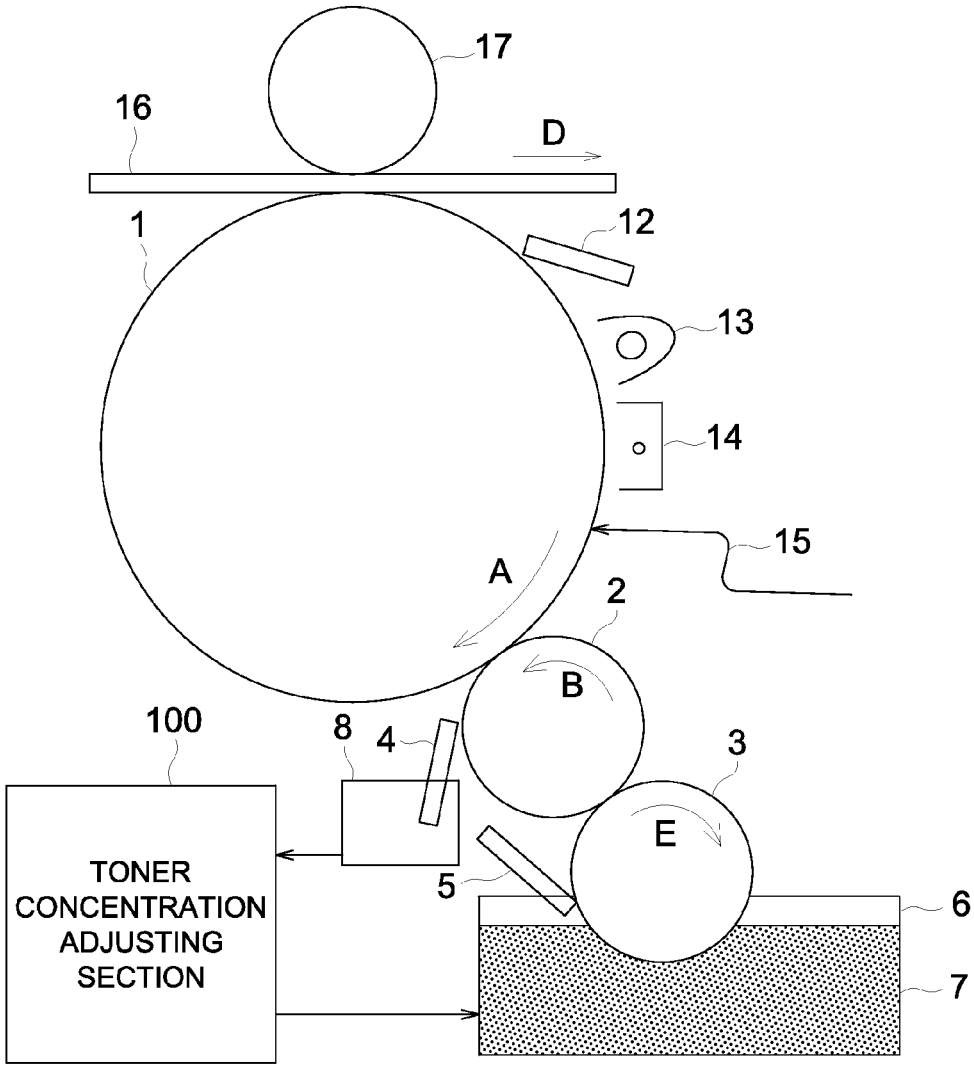
FIG. 1 is an example of a schematic constitution of a wet type image forming apparatus, that is, a structural drawing to show an outline of an electrophotographic process utilizing a wet type developer.

FIG. 1 is an example of an outline constitution of a wet type image forming apparatus, that is, a structural drawing to show an outline of an electrophotographic process utilizing a wet type developer. An example of an outline constitution and operation of a wet type image forming apparatus equipped with a toner concentration adjusting system will be explained in reference to FIG. 1.

In FIG. 1, reference numeral 1 is a photoconductor as an image carrier which rotates in the reception of A in the drawing.

Photoconductor 1 is charged at a uniform potential by charging device 14. Thereafter, it is exposed with exposing device 15 to reduce the potential in the image portion, whereby an electrostatic latent image is formed.

The surface of photoconductor 1 on which an electrostatic latent image has been formed is transferred to a development section, which is an opposing portion against developing roller 2, by the above-described rotation.

In the development section, wet type developer 7 on developing roller 2 is brought in contact with photoconductor 1 to develop the electrostatic latent image.

Wet type developer 7 is constituted of toner particles, comprising a colorant and a resin, and a dispersing medium to disperse said particles. Toner particles on developing roller 2 are charged and toner particles are electrostatically transferred to the photoconductor 1 side in an image portion on photoconductor 1 and are left on the developing roller 2 side in a non-image portion.

Toner particles having been developed on photoconductor 1 are transferred to the transfer section which is an opposing portion against transferring roller 17.

In the transfer section, printing material 16 is conveyed in the arrow D direction, and the toner particles on photoconductor 1 are transferred onto printing material 16 by a voltage having a polarity opposite to that of the toner particles applied on transferring roll 17. Printing material 16 on which the toner particles having been transferred is conveyed to a fixing section (not shown in the drawing) and the toner image is fixed.

On the other hand, cleaning means 12 is arranged opposing to photoconductor 1 having passed through the transfer section and the residual toner particles and dispersion medium remaining after transfer are recovered.

Photoconductor 1 having been recovered with toner particles and dispersion medium is exposed by eraser lamp 13 to a cancel latent image potential.

Further, since the toner particles remaining without being consumed for development and the dispersion medium are present on developing roller 2 having passed through the development section, cleaning blade 4 to remove them and recovering tank 8 to store the developer recovered by blade 4 are provided.

By repeating these processes, images are continuously printed.

Figure 2:
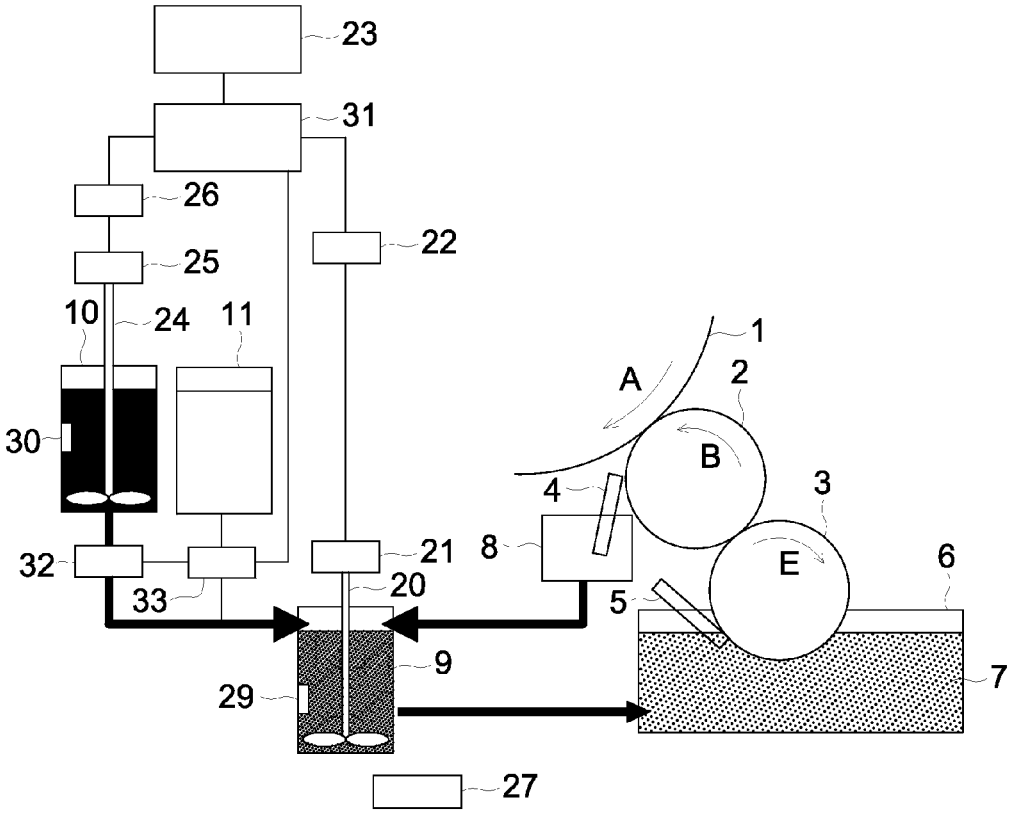
FIG. 2 is a structural drawing to show an example of a detailed constitution of a development section and a concentration adjusting section for a recovered developer in FIG. 1.

FIG. 2 is a structural drawing to show an example of a detailed constitution of a development section and toner concentration adjusting section 100 for a recovered developer. Next, an example of the constitution and movements of a development section and toner concentration adjusting section 100 will be detailed in reference to FIG. 2.

<Constitution and Operation of Development Section>

A development section will now be explained.

Wet type developer 7 constituted of toner particles containing colorant and resin and dispersion medium to disperse the particles therein is stored in wet type developer tank 6.

Drawing up roller 3, a part of which is immersed in wet type developer 7, draws up wet type developer 7 by rotation in the arrow E direction.

Regulating member 5 to regulate wet type developer 7 to a constant thickness is arranged on drawing up roller 3, whereby the thickness of wet type developer 7 drawn up becomes constant. It is possible to regulate a wet type developer accurately by utilizing a metal roller having roughness on the surface (Anilox Roller) as drawing up roller 3.

Wet type developer 7 on drawing up roller 3, after having been regulated to a constant amount by regulating member 5, is transferred to the nip portion between drawing up roller 3 and developer roller 2, and is transferred to developing roller 2. Developing roller 2 is rotating in the arrow B direction in the drawing, and each surface is moving in the same direction at the nip portion between drawing u roller 3 and drawing up roller 3.

Wet type developer 7 transferred to developing roller 2 is conveyed to the nip portion between developing roller 2 and photoconductor 1 to perform development.

The toner particles and the dispersing medium adhere on the image portion on photoconductor 1 after development, while only dispersing medium adheres on the non-image portion. On the contrary, dispersion medium adheres on the image portion of developing roller 2 after development while toner particles and a dispersion medium adhere on the non-image portion.

When wet type developer 7 is additionally supplied on developing roller 2 in this state, unevenness in toner amount will be generated on developing roller 2, which results in image noise. To prevent this problem, blade 4 to recover wet type developer 7 not having been utilized in development on developing roller 2 after development, and the wet type developer thus recovered by blade 4 is put into recovery tank 8 as a recovered developer.

A wet type developer which has been recovered by blade 4 and stored in recovery tank 8 is reused as a recovered developer, however, the toner concentration differs from that of an original developer by passing through a development section.

When the recovered developer is returned to wet type developer tank 6, the toner concentration therein will change, therefore the recovered developer is not returned to wet type developer tank 6 but sent to toner concentration adjusting tank 9 for toner concentration adjustment.

Next, toner concentration adjusting section 100 constituted of toner concentration adjusting tank 9 as a principal portion will be explained. Toner concentration adjusting section 100 functions as a toner concentration adjusting system.

First Embodiment

Functional Constitution of Tone Concentration Adjusting System

Figure 3:
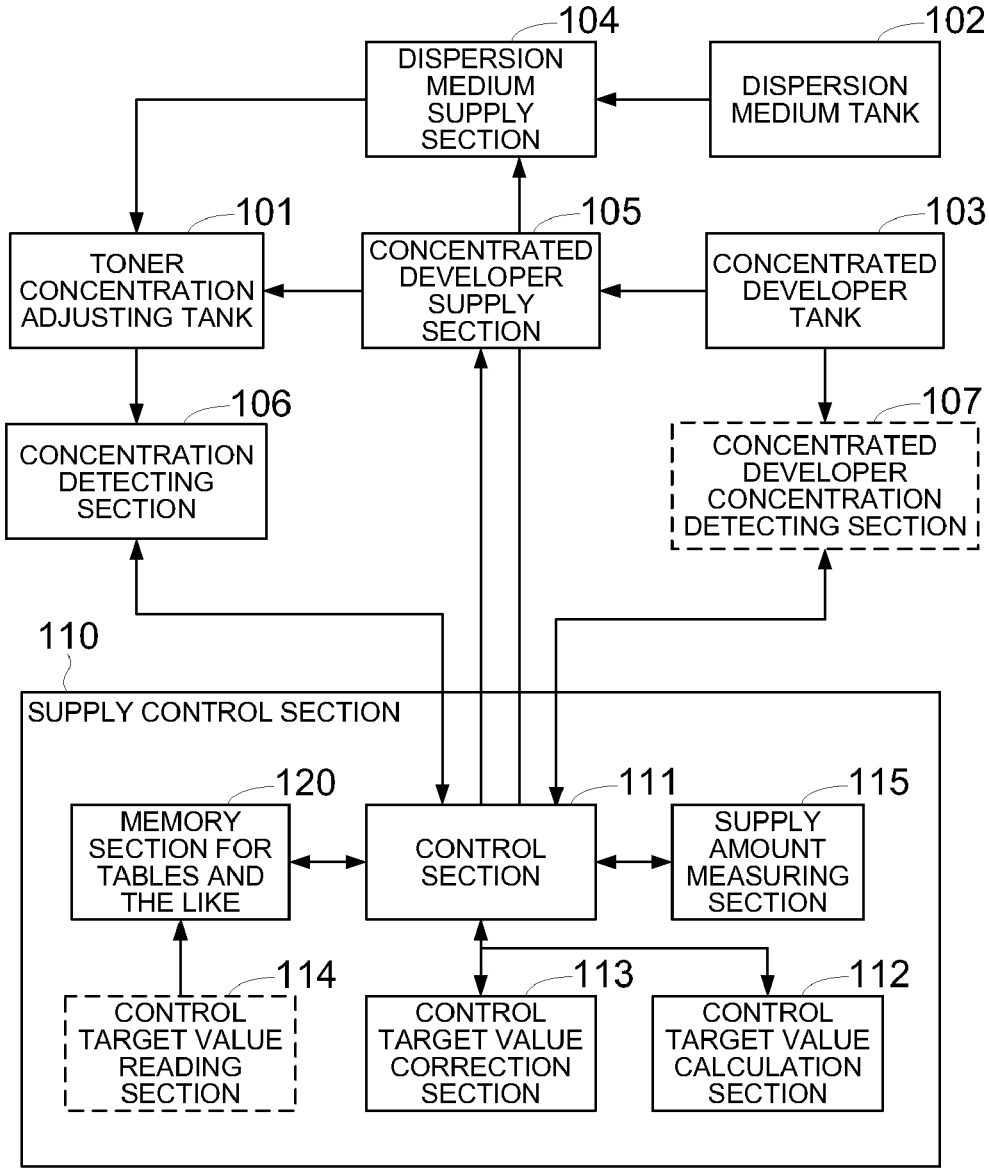
FIG. 3 is a block diagram to show an example of an outline functional constitution of a toner concentration adjusting system according to the first embodiment of the invention.

FIG. 3 is a block diagram to show an example of outline functional constitution of a toner concentration adjusting system according to a first embodiment of this invention. An example of outline functional constitution of a toner concentration adjusting system according to the first embodiment will be explained in reference to FIG. 3.

In FIG. 3, reference numeral 101 is a toner concentration adjusting tank. It stores a wet type developer containing toner and dispersion medium, and adjusts the viscosity which is a substitute characteristic of toner concentration of a wet type developer in toner concentration adjusting tank 101 so that the viscosity becomes equal to the first control target value corresponding to the predetermined standard toner concentration.

Reference numeral 102 is a dispersion medium tank. It stores dispersion medium to be supplied when the toner concentration (viscosity) in toner concentration adjusting tank 101 is higher than the first control target value.

Reference numeral 103 is a concentrated developer tank. It stores a concentrated developer having higher toner concentration than the standard toner concentration and supplies when the toner concentration (viscosity) in toner concentration adjusting tank 101 is lower than the first control target value.

Reference numeral 104 is a dispersion medium supply section. It supplies dispersion medium from dispersion medium tank 102 according to the indication of supply control section 110, which will be described later, when the toner concentration (viscosity) in toner concentration adjusting tank 101 is higher than the first control target value.

Reference numeral 105 is a concentrated developer supply section. It supplies a concentrated developer from concentrated developer tank 103 according to the indication of supply control section 110, which will be described later, when the toner concentration (viscosity) in toner concentration adjusting tank 101 is lower than the first control target value.

Reference numeral 106 is a concentration detecting section. It detects toner concentration of the wet type developer in toner concentration adjusting tank 101. It actually detects a substitute characteristic (viscosity) which can be compared with a control target value.

Reference numeral 107 is a concentrated developer concentration detecting section. It detects the viscosity of the concentrated developer in concentrated developer tank 103 to calculate the second control target value corresponding, which is the viscosity when the concentrated developer is diluted to the standard toner concentration. A substitute characteristic (viscosity) is utilized similarly to the case of the toner concentration of the wet type developer in toner concentration adjusting tank 101.

Reference numeral 110 is a supply control section. It controls supply of a concentrated developer and dispersion medium to adjust the toner concentration of the wet type developer in toner concentration adjusting tank 101 while comparing the toner concentration (viscosity) detection result by concentration detecting section 106 with the control target value. Further, it also calculates control target value and conducts correction.

Functions such as described below are included in supply control section 110.

Reference numeral 111 is a control section. It is equipped with a CPU and totally controls each function with which supply control section 110 is equipped. In particular, for toner concentration adjustment of the wet type developer in toner concentration adjusting tank 101, the control section 111 compares the detected result of toner concentration (viscosity) by concentration detecting section 106 with the corrected first control target value, which will be described later, and sends instructions to concentrated developer supply section 105 or dispersion medium supply section 104 to perform supply of a concentrated developer or dispersion medium.

Reference numeral 112 is a control target value calculation section. In particular, with respect to a concentrated developer in concentrated developer tank 103 to be newly utilized, it calculates the second control target value corresponding to the viscosity when the concentrated developer is diluted to the standard toner concentration, based on the detected result of toner concentration (viscosity) while making a correction by using a standard temperature.

Reference numeral 113 is control target value correction section. In particular, it performs correction of the first control target value with respect to the wet type developer in toner concentration adjusting tank 101, based on the second control target value for a concentrated developer to be supplied and the cumulative supply amount of a concentrated developer measured by supply amount measuring section 115 which will be described later.

Reference numeral 115 is a supply amount measuring section. It measures the cumulative supply amount of concentrated developer by concentrated developer supply section 105 required for correction of the first control target value at control target value correction section 113.

Reference numeral 120 is a memory section for tables and the like. It memorizes a value, a numerical value table and a conversion equation necessary for each of the above-described processes being totally controlled by control section 111, and which will be appropriately referred to. Herein, the memory section may be arranged outside of supply control section 110.

The details of each function of supply control section 110, the outline of which has been described above, will be described later as a procedure of toner concentration control.

<Constitution and Operations of Toner Concentration Adjusting Section>

Returning to FIG. 2, an example of specific constitution and movements of a toner concentration adjusting section will be described.

A wet type developer having been recovered by blade 4 and stored in recovery tank 8 is reused as a recovered developer. The recovered developer is sent to toner concentration adjusting tank 9 (reference numeral 101 in FIG. 3) for toner concentration adjustment.

Toner concentration adjustment tank 9 is equipped with stirring member 20, which stirs the stored wet type developer with rotation of motor 21. Motor 21 is controlled so as to be rotated at a constant rotation speed and current detecting device 22 to detect current at that rotation speed is provided.

Stirring member 20, motor 21 and current detecting device 22 function as a concentration detecting section (reference numeral 106 of FIG. 3). A viscosity characteristic is measured as a substitute characteristic of a toner concentration based on a current value as a rotation load. The details will be described later.

Figure 4:
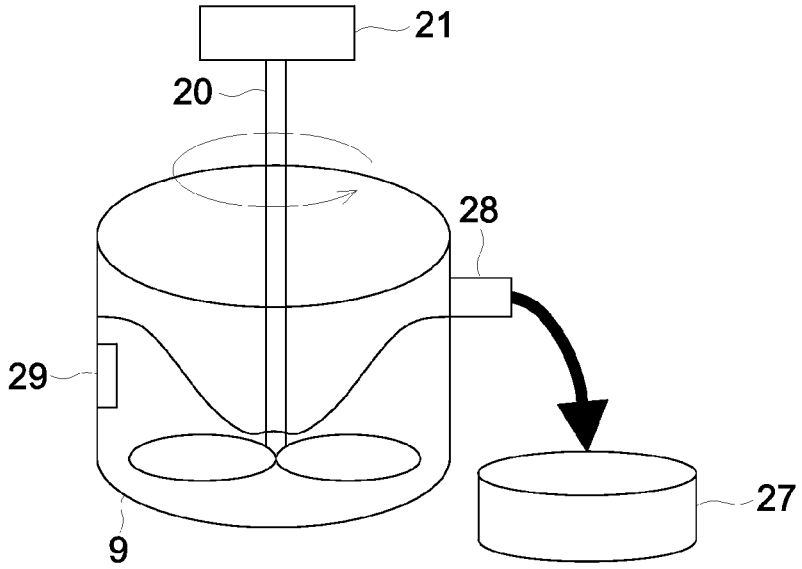
FIG. 4 is a drawing to show the structure of toner concentration adjusting tank 9 in which an opening 28 for a wet type developer to overflow is provided.

Toner concentration adjusting tank 9 is equipped with opening 28 to overflow wet type developer (refer to FIG. 4), and wet type developer overflowed is recovered in vessel 27. The wet type developer recovered in this vessel 27 is returned to toner concentration adjusting tank 9 again. The amount of the wet type developer in toner concentration adjusting tank 9 during stirring is kept constant by overflowing.

Detection of toner concentration (viscosity) should be conducted in a state of a developer overflowing (the amount of a developer is controlled constant). Further, toner concentration adjusting tank 9 is equipped with temperature detection device 29 to measure the temperature of a wet type developer.

Concentrated developer tank 10 (reference numeral 103 in FIG. 3) to store a concentrated developer having high toner concentration and dispersion medium tank 11 (reference numeral 102 in FIG. 3) to store dispersion medium are connected to toner concentration adjusting tank 9, and the dispersion medium is supplied from dispersion medium supply device 33 in the case where the toner concentration in a developer is judged to be higher by toner concentration (viscosity) detection, which will be described later, and a concentrated developer is supplied from concentrated developer supply device 32 in the case where the toner concentration is judged to be lower.

Dispersion medium supply device 33 functions as a dispersion medium supply section (reference numeral 104 in FIG. 3) and concentrated developer supply devise 32 functions as a concentrated developer supply section (reference numeral 105 in FIG. 3).

Concentrated developer tank 10 is equipped with stirring member 24, motor 25, motor current detection device 26 and temperature detection device 30, similar to toner concentration adjusting tank 9. They function as a concentrated developer concentration detecting section (reference numeral 107 in FIG. 3).

The wet type developer, whose toner concentration has been adjusted in toner concentration adjusting tank 9, is returned to wet type developer tank 6 to be used for development.

It is preferable not to add a developer into toner concentration adjusting tank 9 from recovery tank 8 and vessel 27 when the toner concentration is being adjusted in toner concentration adjusting tank 9.

<Tone Concentration Detection Based on Viscosity>

A wet type developer contains toner particles as a solid dispersed in dispersion medium, and the toner concentration is represented by a weight ratio of the toner particles with respect the wet type developer.

When the toner concentration is high, the toner amount with respect to the dispersion medium is large and the viscosity of the wet type developer is high. On the contrary, when toner concentration is low, the toner amount with respect to the dispersion medium is small and the viscosity of a wet type developer is low. That is, the measurement of the toner concentration of wet type developer can be replaced by measuring the viscosity of the wet type developer.

Figure 5:
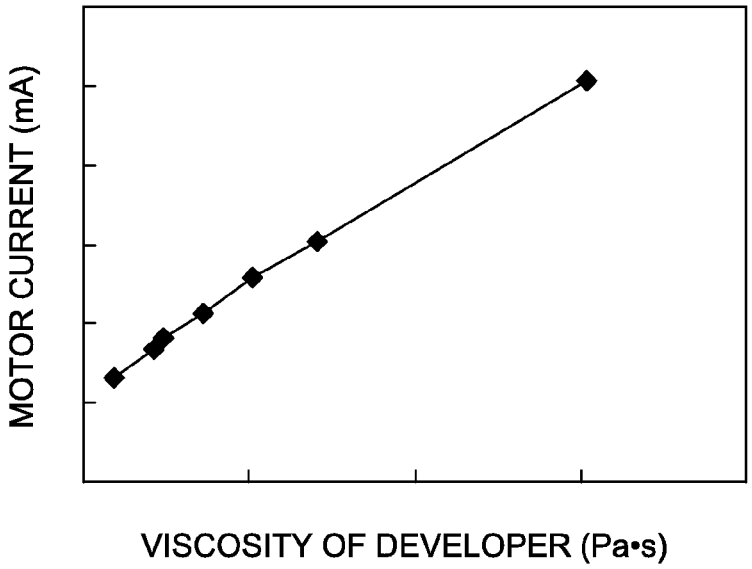
FIG. 5 is a graph to show the relationship between viscosity of a wet type developer and current required to rotate stirring motor 21 at a predetermined speed.

The relationship between the viscosity of wet type developer and electric current required to rotate stirring motor 21 at a constant speed is shown in FIG. 5. The current is detected by current detection device 22 shown in FIG. 2. The load of stirring with stirring member 20 is higher when the viscosity of a wet type developer higher, which results in higher current consumption of motor 21 to stir at a constant rotation speed.

It is clear from FIG. 5 that there is a proportional relationship between viscosity of a wet type developer and current consumption of stirring motor 21, and it is possible to measure the viscosity of wet type developer by detecting current of stirring motor 21 with current detection device 22.

Figure 6:
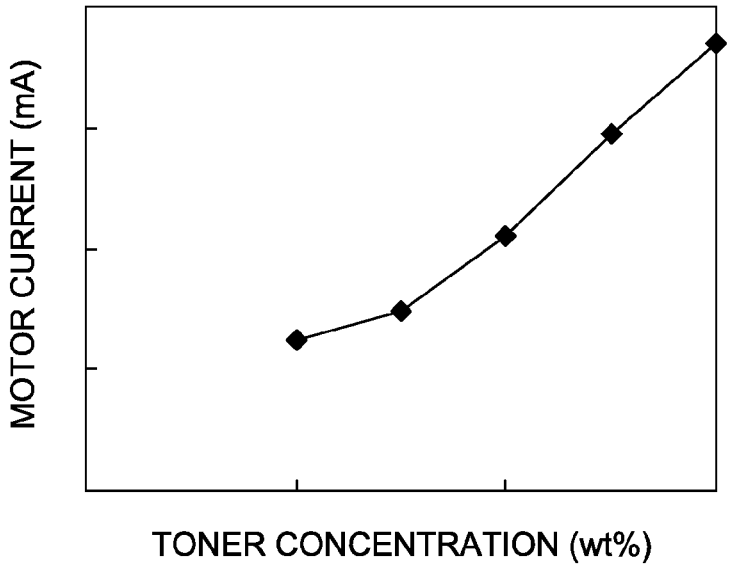
FIG. 6 is a graph to show the relationship between toner concentration of a wet type developer and current of stirring motor 21.

Similarly, the relationship between toner concentration of wet type developer and current of stirring motor 21 is shown in FIG. 6. The toner concentration of a wet type developer also can be detected based on current of stirring motor 21.

<Toner Concentration Adjustment>

The current value of stirring motor 21 detected by current detection device 22 is compared with a control target value (a current value at a target standard toner concentration) by control device 31. Control device 31 functions as a supply control section (reference numeral 110 in FIG. 3).

Thus, in the case where the current value is judged to be lower than a control target value, that is, the toner concentration is judged to be lower than a standard toner concentration, a concentrated developer in concentrated developer tank 10 will be supplied into toner concentration adjusting tank 9.

On the contrary, in the case where the current value of stirring motor is judged to be higher than the control target value, that is, the toner concentration is judged to be higher than the standard toner concentration, dispersion medium in dispersion medium tank 11 will be supplied into toner concentration adjusting tank 9.

These operations are repeated until the current of stirring motor 21 coincides with the target value or comes into a certain range. Thus, the toner concentration of the wet developer in toner concentration adjusting tank 9 is adjusted to a constant value (the standard toner concentration).

The wet type developer whose toner concentration o has been adjusted is transferred to wet type developer tank 6.

<Error of Toner Concentration Measurement>

Figure 7:
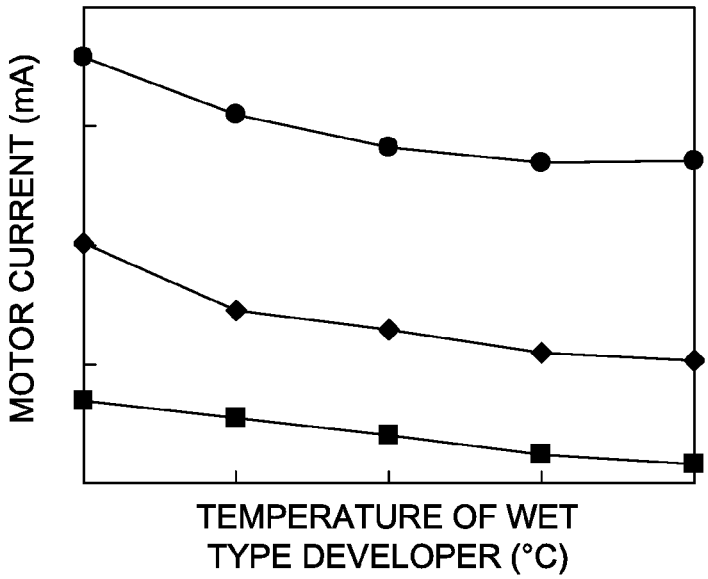
FIG. 7 is a graph to show the relationship between temperature of a wet type developer and electric current of stirring motor 21.

However, detected current of motor 21 is different even for the same toner concentration when the temperature of the wet type developer differs (three lines in FIG. 7 are for different toner concentrations). This is because the viscosity of dispersion medium in wet type developer depends on temperature of wet type developer.

When the temperature increases, the viscosity of dispersion medium is decreased and the viscosity of the wet type developer is decreased. On the contrary, when the temperature decreases, the viscosity of the dispersion medium is increased and the viscosity of a wet type developer is increased. To compensate this difference, needed are countermeasures such as "to maintain temperature of the wet type developer constant" or "to measure temperature of the developer and correct a target value of current to a target value at a standard temperature".

Further, physical properties of wet type also depend on manufacturing lots. In particular, with respect to toner particles, even if they are manufactured in the same manner, fluctuations in the particle size and form will vary depending on the surrounding environment, materials of resin, dispersed state and types of pigment.

Figure 8:
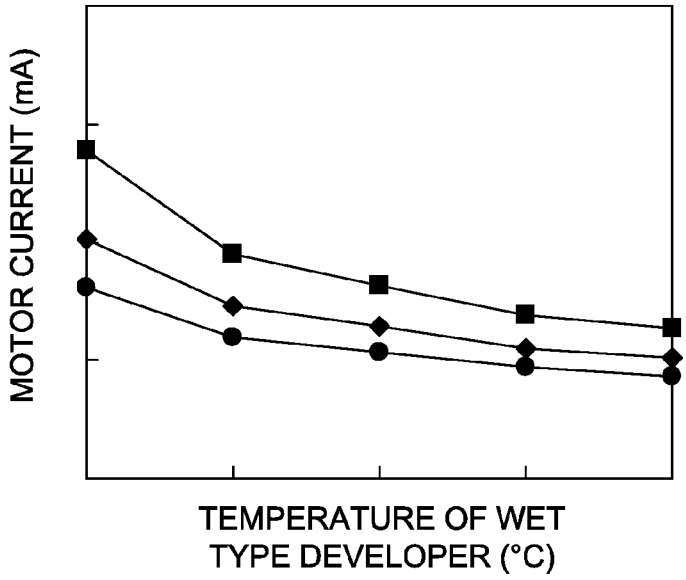
FIG. 8 is a graph to show the relationship between temperature and current of stirring motor 21 with respect to wet type developers of different lots.

When the particle size or form of toner particles fluctuates, viscosity of the wet type developer differs even at the same toner concentration, and as a result, a current value of stirring motor 21 will differ (refer to FIG. 8, lines a, b and c differ in manufacturing lots). When the current value of stirring motor 21, that is, viscosity is controlled to a constant target value for wet type developer with different viscosities, toner concentration of a wet type developer varies.

Further, since a concentrated developer of a different lot is actually supplied to wet type developer, toner particles in the wet type developer is replaced at each supply of the concentrated developer. Therefore, viscosity of the wet type developer varies even with the same toner concentration, due to difference of lot.

Figure 9:
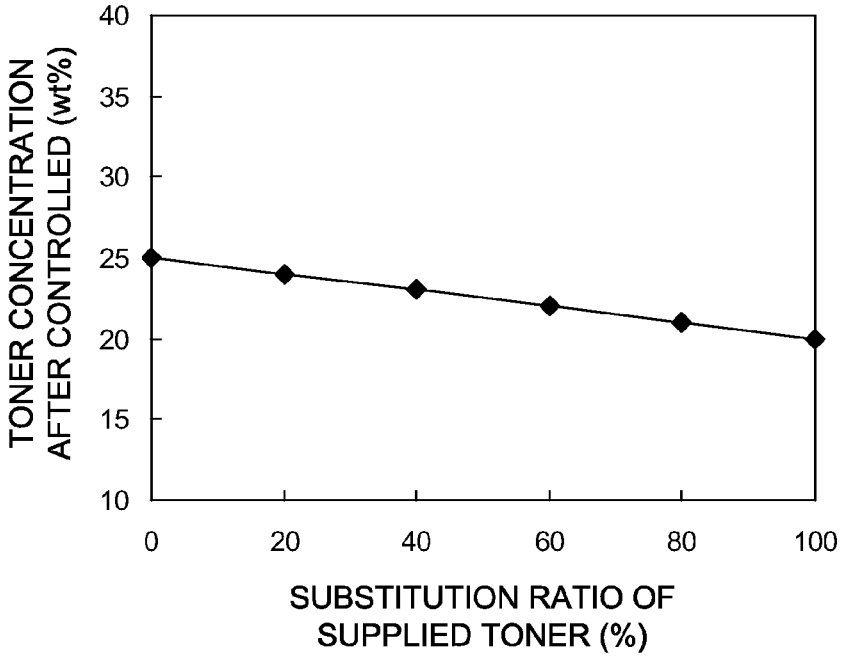
FIG. 9 is a graph to show the relationship between the toner substitution ratio due to toner supply of a different lot and the toner concentration.

For example, in the case of supplying wet type developer c against wet type developer b in FIG. 8, the actual toner concentration will change as shown in FIG. 9 when toner concentration is controlled in accordance with the control target value of a detected current for only wet type developer b and supply is conducted (substitution ratio of 100% is a state where all of the original toner (wet type developer b) is consumed and all of the toner is newly supplied one (wet type developer c)).

Therefore, it is necessary to correct the control target value of a detected current depending on the supply amount of developer c.

<Correction of Target Value of Detected Current>

Figure 10:
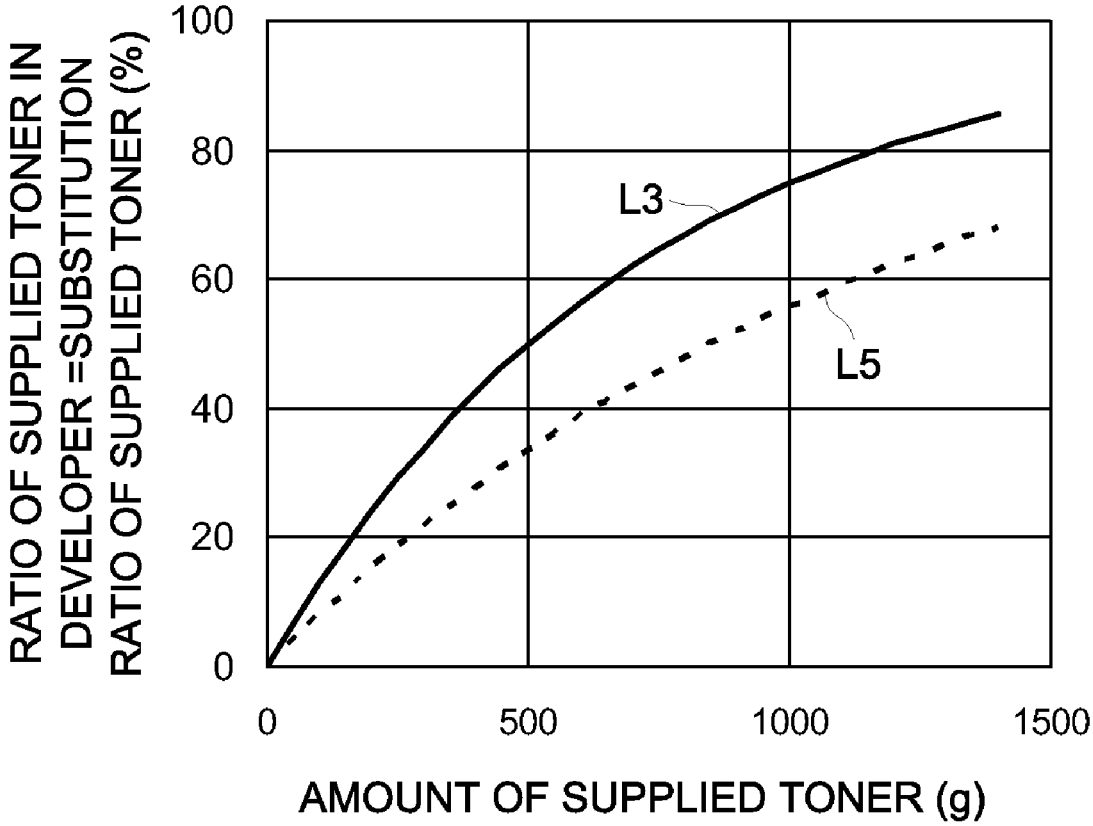
FIG. 10 is a graph to show the toner substitution ratio in a wet type developer with respect to the toner supply amount of concentrated developer.

The substitution ratio of toner for wet type developer with respect to a supply amount of a concentrated developer is shown in FIG. 10. Line L3 represents the case of the total amount of wet type developer being 3 L, and line L5 represents the case of 5 L.

In the case of supplying a concentrated developer, a supplied toner is also consumed. Therefore, it is necessary to supply a large amount of toner to substitute 100% of the toner in the wet type developer with the supplied toner. Actually, the volume of concentrated developer tank 10 is not very large, and there is only small possibility of substitution by 100% of the toner in the wet type developer.

Further, the substitution ratio depends on the amounts of the wet type developer in wet type developer tank 6 and that of toner concentration adjusting tank 9, and for example, a substitution behavior is as shown by solid line (L3) in FIG. 10 in the case where the sum of the amounts of the wet type developer in wet type developer tank 6 and toner concentration adjusting tank 9 is 3 L and the toner concentration of the wet type developer is 25% by mass.

Therefore, by monitoring the supply amount of the concentrated developer, it is possible to determine the present substitution ratio based on FIG. 10 (the supplied toner amount in FIG. 10 is the toner amount in a supplied concentrated developer, and is divided by the toner concentration of the concentrated developer to be converted into the amount of the concentrated developer.).

After the substitution ratio is determined, it is possible to correct the target value of control according to the following equation, when the control target value in the original developer is the first control target value, and the control target value determined for the developer to be supplied is the second control target value.

Corrected first control target value=present first control target value+(second control target value−present control target value)×substitution ratio This calculation is conducted by control device 31 as a supply control section (control target value correction section 113).

Further, control device 31 also functions as a supply amount measuring section (reference numeral 115 in FIG. 3), and calculates the cumulative supply amount by monitoring the concentrated developer supply amount to calculate the substitution ratio.

Further, control device 31 is provided with a function to calculate the second control target value for the concentrated developer (control target value calculation section 112 in FIG. 3). This calculation of the second control target value will be explained below.

<Second Control Target Value Calculation for Concentrated Developer to be Supplied>

When a concentrated developer is used up, a certain amount of a new concentrated developer, which has toner concentration higher than the wet type developer and the toner concentration of which is known, is supplied into concentrated developer tank 10.

Concentrated developer tank 10 is equipped with stirring member 24 and stirring motor 25 similarly to toner concentration adjusting tank 9, in addition to current detecting device 26 which detect current required to rotate stirring motor 25 at a predetermined speed, and device 30 to detect temperature of the concentrated developer.

When a new concentrated developer is supplied into concentrated developer tank 10, a current value as the second control target value corresponding to the viscosity of the concentrated developer being diluted to a standard toner concentration is determined according to the following steps. Since a concentrated developer has a higher toner concentration compared to wet type developer 7, it is necessary to calculate a current value as a control target value in the case where the concentrated developer is diluted to the same concentration as wet type developer 7 (equivalent to the standard toner concentration).

1. Measure the temperature of the concentrated developer.
2. Rotate stirring member 24 by stirring motor 25 at a predetermined speed, and measure the required current.
3. Determine the current at the standard temperature and at the toner concentration of the concentrated developer from the temperature of the concentrated developer, the detected current and the relationship between the temperature of the wet type developer and the current value (kept in memory section 120 as table data in advance) at the toner concentration of the concentrated developer in FIG. 7.

4. Determine the current value as the second control target value at the time of being diluted to the toner concentration identical to wet type developer 7 (equivalent to the standard toner concentration) from the relationship between the toner concentration and the current at a standard temperature in FIG. 6 (this will be also kept in memory section 120 as table data in advance).

The detailed procedure of the above process will be described later.

In the above description, the description is made in the case of measuring the temperature in concentrated developer tank 10; however, it is not necessary to correct temperature when a temperature controller is arranged in the circumference of concentrated developer tank 10 to maintain the temperature of a concentrated developer to be constant.

<Preparation of Correction Table>

Preparation of the table data for various corrections which is required for the above-described correction process of the control target value will now be explained. These table data are memorized in memory section 23 (memory section 120 for tables and the like in FIG. 3) to be utilized in the procedure of toner concentration control.

(1) Table for Temperature Correction of Viscosity Characteristic (Detected Current)

Figure 11:
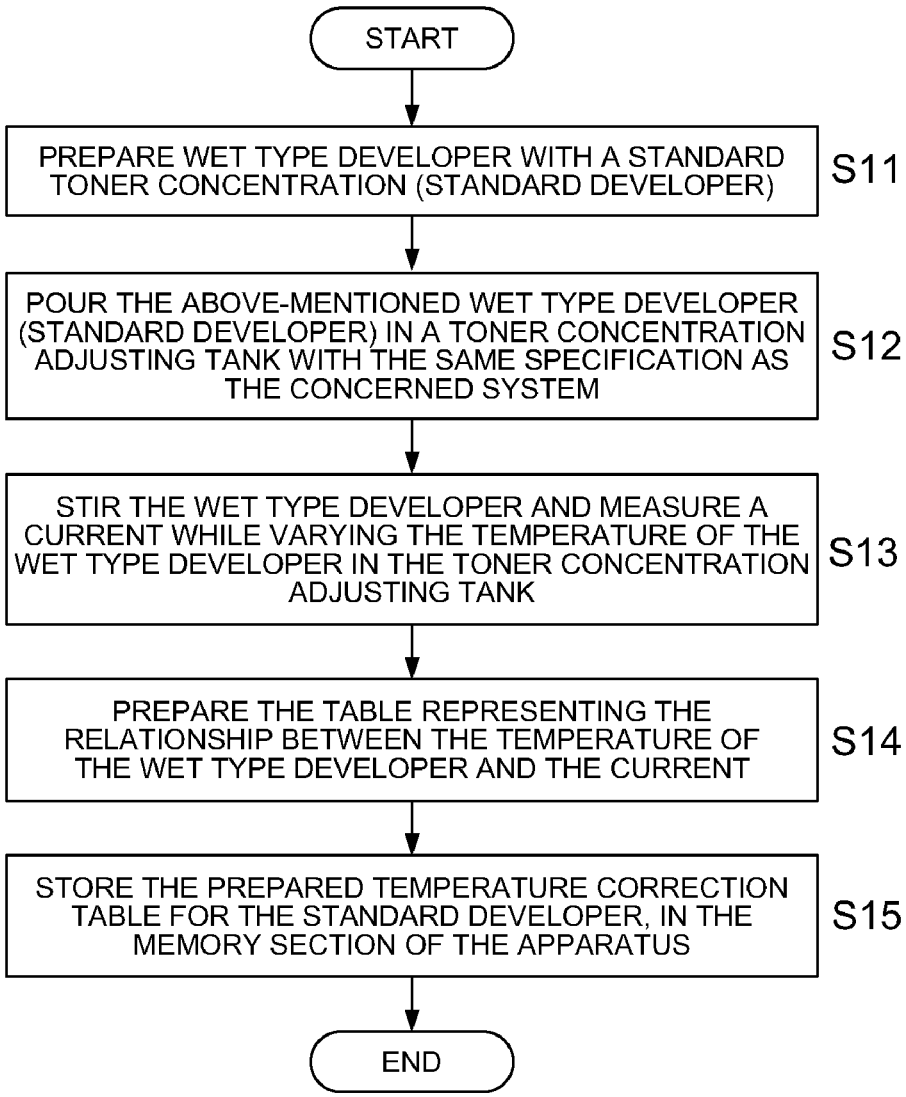
FIG. 11 is a flow chart to show a preparation procedure of a table representing the relationship between temperature and detected current with respect to a wet type developer having a standard toner concentration.

FIG. 11 is a flow chart to show the preparation procedure of the table representing the relationship between temperature and detected current with respect to a wet type developer having a standard toner concentration.

First, in step S11, wet type developer having a standard toner concentration (a standard developer) is prepared.

Next, in step S12, the above-described standard developer is poured in a toner concentration adjusting tank having identical specifications with said toner concentration adjusting system.

In step S13, temperature of the standard developer is measured while varying temperature of the standard developer in the toner concentration adjusting tank. Further, the standard developer is stirred, and the current and the temperature are measured simultaneously.

In step S14, a table to show the relationship between the temperature and the current value (viscosity) with respect to the wet type developer having the standard toner concentration is prepared. Thus, the correlation as shown in FIG. 7 is obtained.

In step 15, the table prepared in step 14 is memorized in memory section 23 of the toner concentration adjusting section.

(2) Table for Temperature Correction of Concentrated Developer

Figure 12:
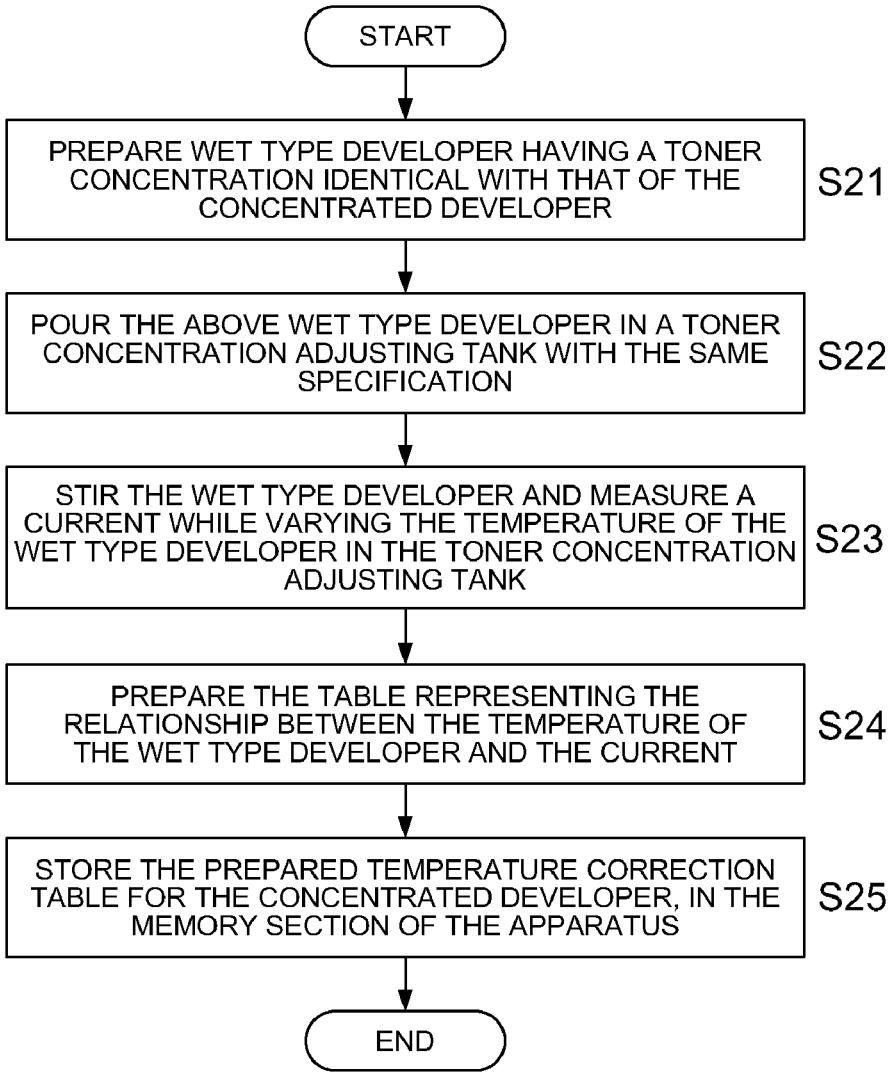
FIG. 12 is a flow chart to show a preparation procedure of a table representing the relationship between temperature and detected current with respect to a concentrated developer having a high toner concentration.

FIG. 12 is a flow chart to show the preparation procedure of a table representing the relationship between the temperature and the detected current with respect to a concentrated developer having a high toner concentration. It is similar to the preparation of the temperature correction table with respect to the wet type developer having the standard toner concentration (FIG. 11), except that in this procedure a wet type developer having an identical toner concentration with the concentrated developer is utilized.

First in step S21, wet type developer having an identical toner concentration with the concentrated developer is prepared.

Next, in step 22, the above-described wet type developer is poured into a toner concentration adjusting tank having identical specifications with the toner concentration adjusting system.

In step 23, temperature of the wet type developer is measured while varying temperature of the wet type developer in the toner concentration adjusting tank. Further, the wet type developer is stirred and a current value and the temperature are measured simultaneously.

In step S24, a table to show the relationship between the temperature and the current value (viscosity) with respect to the concentrated developer is prepared. Thus, the correlation as shown in FIG. 7 is obtained.

In step 25, the table prepared in step 24 is memorized in memory section 23 of the toner concentration adjusting section.

Figure 13:
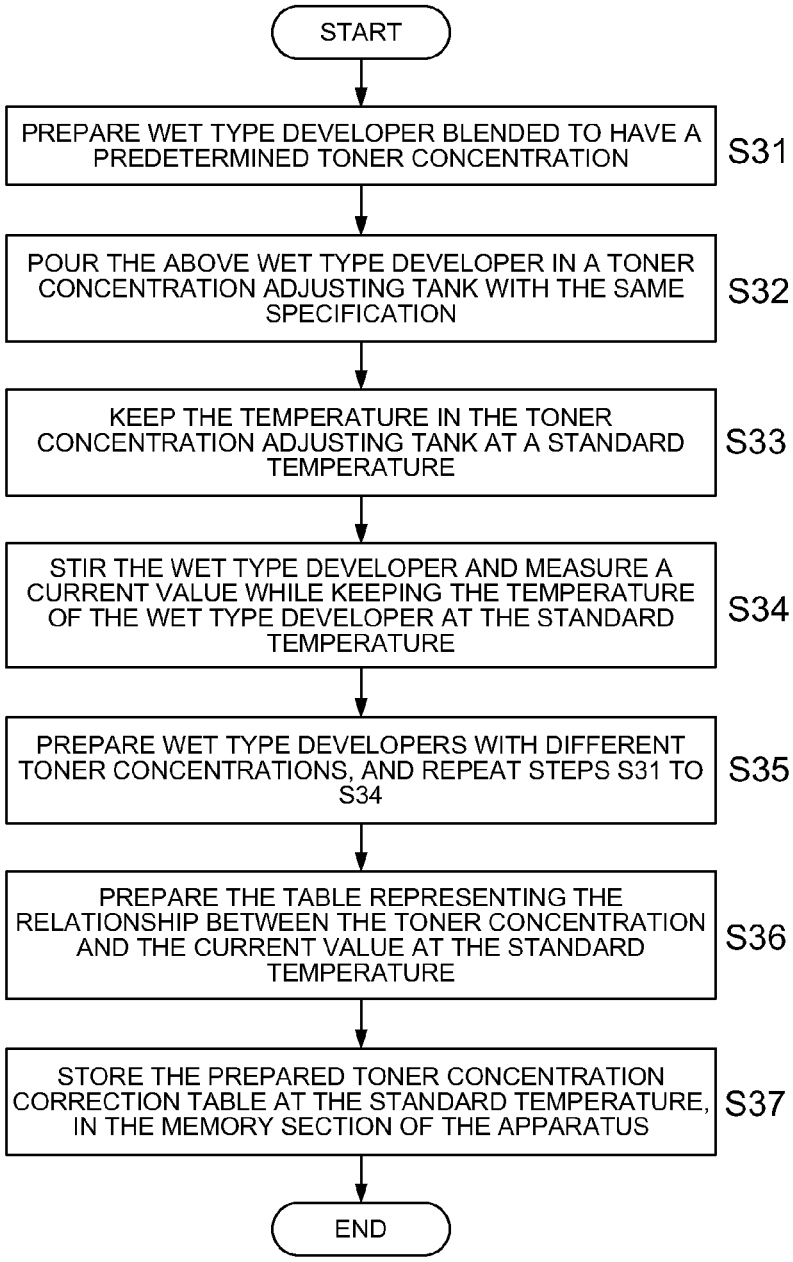
FIG. 13 is a flow chart to show a preparation procedure of a table representing the relationship between toner concentration and detected current with respect to a wet type developer at a standard temperature.

(3) Table for Correction of Viscosity Characteristic (Detected Current) by Toner Concentration FIG. 13 is a flow chart to show the preparation procedure of a table representing the relationship between the toner concentration and the detected current with respect to the wet type developer at the standard temperature.

First, in step S31, a wet type developer blended to have a certain toner concentration is prepared.

Next, in step S32, the above-described wet type developer is poured into a toner concentration adjusting tank having the identical specifications with the toner concentration adjusting system.

In step S33, temperature of the wet type developer in the toner concentration adjusting tank is kept at a standard temperature.

In step S 34, the wet type developer is stirred while keeping the wet type developer in the toner concentration adjusting tank at the standard temperature, and a current value at this time is measured.

In step 35, plural wet type developers having different toner concentrations are prepared and steps S32-S34 are repeated for respective developers.

In step S36, the relationship between each toner concentration and the corresponding current value is summarized to prepare the table to show the relationship between the toner concentration and the current value (viscosity) with respect to the wet type developer at the standard temperature. Thus, the correlation as shown in FIG. 6 is obtained.

In step S37, the table obtained in step S36 is memorized in memory section 23 of the toner concentration adjusting section.

The above-described three correction tables are prepared before shipping of an apparatus equipped with said toner concentration adjusting system and are memorized in memory section 23 of each apparatus.

<Processing Procedure at New Supply of Concentrated Developer>

Figure 14:
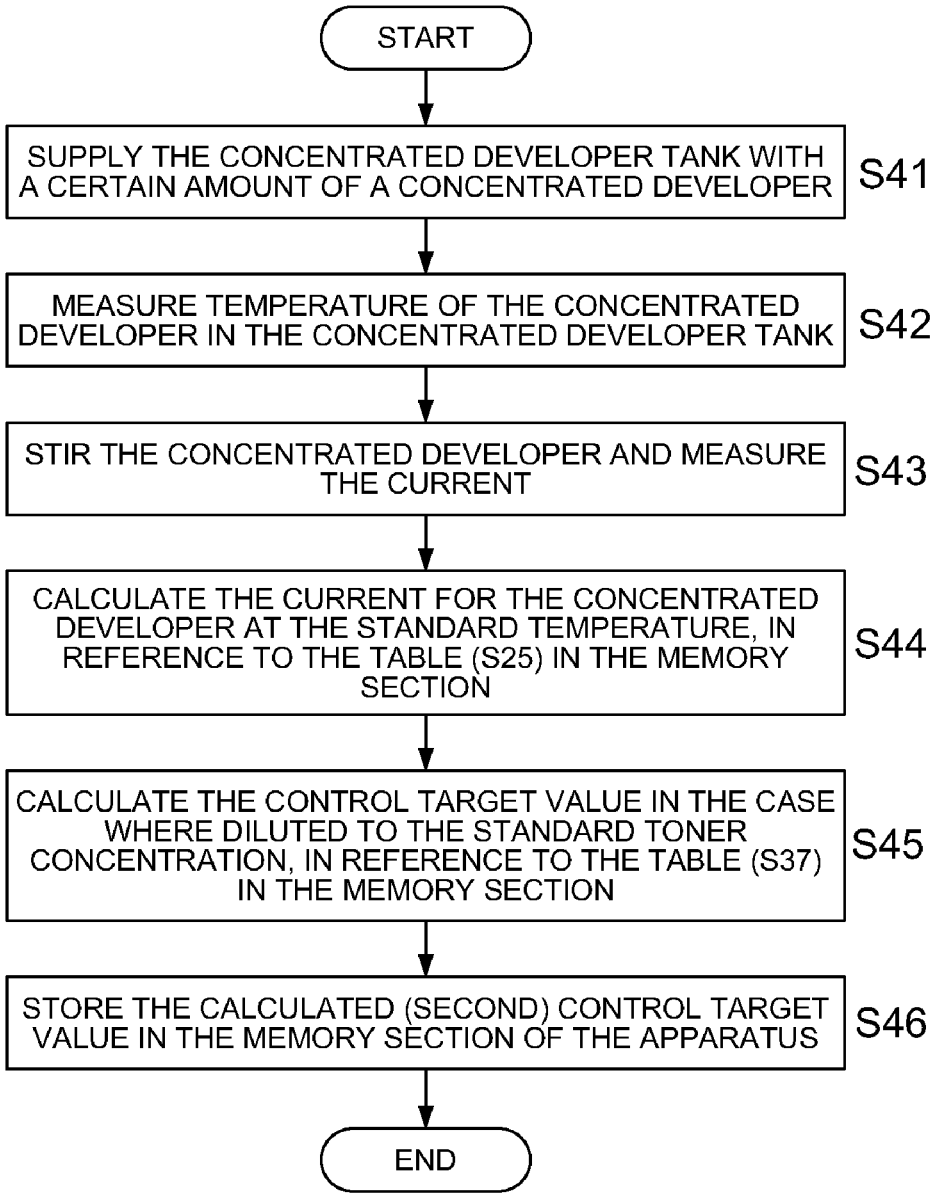
FIG. 14 is a flow chart to show a processing procedure to set the (secondary) control target value at the time of newly supplying a concentrated developer.

FIG. 14 is a flow chart to show the processing procedure to set the control target value (the second control target value corresponding to the viscosity when being diluted to the standard toner concentration) at the time of a concentrated developer having been newly supplied into concentrated developer tank 10. The processing procedure to set the (second) control target value with respect to the concentrated developer will be explained in reference to FIG. 14.

First, in step S41, a certain amount of a new concentrated developer is supplied into empty concentrated developer tank 10.

Next, in step S42, temperature of a concentrated developer in concentrated developer tank 10 is measured by temperature detecting device 30.

In step S43, stirring member 24 is rotated at a constant speed by motor 25 and current flows at that time is detected by current detection section 26.

In step S44, the current value of the concentrated developer at the standard temperature is calculated after correction in reference to the temperature correction table having been memorized in memory section 23 in step S25 of FIG. 12. It should be noted that the relationship between the temperature and the current for the concentrated developer fluctuates depending on manufacturing lots of toner, therefore, the current value (viscosity) at the standard temperature is calculated from the gradients of temperature and current.

In step S45, the current value, when the concentrated developer is diluted to the identical toner concentration with that of wet type developer 7 with the standard toner concentration, is calculated as a target current value in reference to the toner concentration correction table at the standard temperature which has been memorized in memory section 23 in step S37 of FIG. 13. This is the (second) control target value of the concentrated developer to be supplied. This target value depends on lots of toner, therefore, it is calculated from the slope or a data table.

In step S46, the (second) control target value of the concentrated developer to be supplied is memorized in memory section 23.

<Processing Procedure of Toner Concentration Control>

Figure 15:
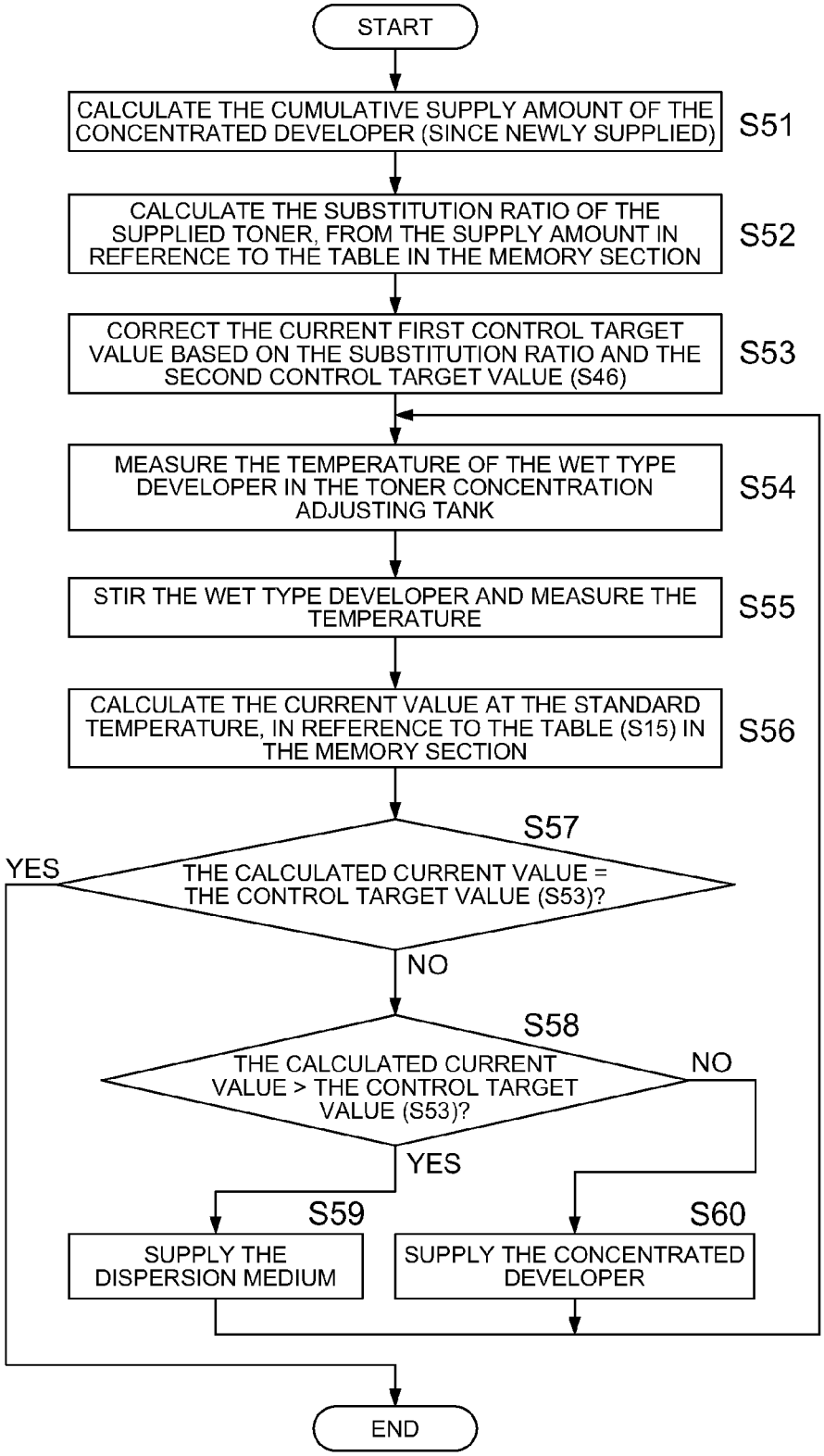
FIG. 15 is a flow chart to show a processing procedure of toner concentration control in a toner concentration adjusting system.

FIG. 15 is a flow chart to show the processing procedure of the toner concentration control in the toner concentration adjusting system. The processing procedure of the toner concentration control will be explained in reference to FIG. 15.

First, in step S51, calculated is the cumulative supply amount of the concentrated developer having been supplied into wet type developer 7 until adjusting control of this time since the concentrated developer has been set in concentrated developer tank 10.

Next, in step S52, calculated is the substitution ratio of the toner having been supplied to wet type developer 7, based on the supply amount of the concentrated developer and in reference to the table in memory section 23.

In step S53, the deviation of the current value caused by the substitution ratio of toner is corrected based on the substitution ratio determined in step S52; the (first) control target value at present; and the (second) control target value of the concentrated developer to be supplied which has been memorized in the memory section in step S46 in FIG. 14, whereby the (first) corrected control target value is determined.

In step S54, temperature of the wet type developer in toner concentration adjusting tank 9 is measured by temperature detecting device 29.

In step S55, stirring member 20 is rotated by motor 21 at a constant speed and current required at this time is detected by current detection section 22.

In step S56, a current value (viscosity) of the wet type developer under measurement at the standard temperature is calculated in reference to the temperature correction table having been memorized in the memory section in step S15 of FIG. 11.

In steps S57 and S58, the current value determined in step S56 is compared with the control target value after correction determined in step S53.

As a result, in the case where the current value at present is higher than the control target value, the procedure is proceeded to step S59 to supply the dispersion medium from dispersion medium tank 11.

On the contrary, in the case where the current value at present is lower than a control target value, a concentrated developer is supplied from concentrated developer tank 10.

Thereafter, the procedure returns to step S54 or step S51 again to repeat the above-described procedure until the current value coincides with the control target value.

Finally, control is finished when the current value at present becomes equal to the control target value.

Naturally, the control target value may be not a certain value but a value having a range. In this case, control is finished when a current value comes into the range.

Further, correction of the control target value depending on the supply amount of the concentrated developer may be conducted at each supply of the concentrated developer, alternatively, may be conducted after supply of a certain amount.

Further, the case where the temperature is detected by use of a temperature detection device is described in this embodiment; instead, control may be conducted to maintain the temperature of wet type developer 7 and the concentrated developer to be constant.

Second Embodiment

In the above described first embodiment, presented is the case in which characteristics of the concentrated developer are measured by providing the concentrated developer concentration detection section, that is stirring member 24, motor 25 and current detection section 26, in concentrated developer tank 10.

In the second embodiment, explained will be the case in which characteristics of the concentrated developer are measured by utilizing toner concentration adjusting tank 9 without conducting detection in concentrated developer tank 10. Therefore, concentrated developer concentration detection section 107 is not necessary in functional constitution of the toner concentration adjusting system (refer to FIG. 3).

The procedure of toner concentration control is almost similar; however, different points in the preparatory operations for that procedure will be described below.

At the time of newly supplying the concentrated developer, the wet type developer in toner concentration adjusting tank 9 is once transferred to vessel 27 to make the inside of toner concentration adjusting tank 9 empty. Thereafter, the concentrated developer and the dispersion medium are supplied into toner concentration adjusting tank 9 so as to make the toner concentration identical with that (standard toner concentration) of wet type developer 7.

In this situation, the temperature of the wet type developer in toner concentration adjusting tank 9 is measured by temperature detection device 29 and the current value required to rotate motor 21 at a constant speed is measured by current detection section 22.

The relationship between the temperature of the wet type developer and the detected current is referred to the table of the temperature of the wet type developer and the detected current with respect to wet type developer 7 at the standard toner concentration memorized in memory section 23, whereby the (second) control target value of the concentrated developer to be supplied is determined.

The (second) control target value of the concentrated developer to be supplied is memorized in memory section 23.

In this way, preparation of the table for the developer temperature and the detected current of the concentrated developer (refer to FIG. 12), preparation of the table for the toner concentration and the detected current at the standard temperature (refer to FIG. 13) and operations at the time of new supply of the concentrated developer (refer to FIG. 14), in the first embodiment, can be omitted.

The processing procedure of toner concentration adjustment of wet type developer is the same as the case of the first embodiment (refer to FIG. 15).

After the (second) control target value of the concentrated developer to be supplied has been memorized in memory section 23, wet type developer in toner concentration adjusting tank 9 is sent to developer tank 6. Further, a wet type developer having been transferred into vessel 27 is returned to toner concentration adjusting tank 9.

Thus, errors will not be caused by difference of devices, because evaluations of the developer and the concentrated developer are conducted in the same device in addition to the advantage of operations for table preparation being omitted. Further, the number of parts will be decreased, which also results in cost reduction.

Third Embodiment

In the above-described first and second embodiments, presented are the cases in which characteristics of the concentrated developer in the apparatus of the toner concentration adjusting system are measured.

In the third embodiment, the case of not measuring characteristics of the concentrated developer in the apparatus will be described. Therefore, concentrated developer concentration detection section 107 in functional constitution of the toner concentration adjusting system (refer to FIG. 3) is not necessary. However, control target value reading section 114 to read the second control target value from a container of a new concentrated developer is required.

The procedure for toner concentration control is almost the same; however, different points in the operations for the control will be described below.

A part of the concentrated developer of each lot is diluted to an identical toner concentration with that of wet type developer 7 (a standard toner concentration) before shipping from a factory, and the table of the temperature and the detected current of the wet type developer is prepared (similar to FIG. 11) for that diluted developer.

Further, a cartridge to store a concentrated developer is equipped with a memory device on which the table of the temperature and the detected current of wet type developer which has been determined above is memorized.

In this state, the above prepared developer is set in the apparatus equipped with the toner concentration adjusting system and the data are read out from the memory device mounted on the cartridge by use of control target value reading section 114, whereby the table of the temperature and the detected current of wet type developer at the standard toner concentration with respect to a new developer to be supplied is obtained as well as the (second) control target value of the new developer to be supplied is determined.

In other words, preparation of the table of the temperature and the detected current of wet type developer at the standard toner concentration of wet type developer 7 (refer to FIG. 11), preparation of the table of the temperature and the detected current of concentrated developer (refer to FIG. 12), preparation of the table of the toner concentration and the detected current at the standard temperature (refer to FIG. 13), and operations at the time of new supply of concentrated developer are not necessary.

The processing procedure of toner concentration adjustment is similar to the case of the first embodiment (refer to FIG. 15).

In this manner, cost reduction is possible due to omission of the operations for table preparation and decrease in the number of parts. Further, the correction based on the characteristics of wet type developer to be supplied is possible, which enables reduction of error.

Fourth Embodiment

Different points with respect to a fourth embodiment, in which modified points having been added to the above-described third embodiment, will be described.

With respect to the third embodiment, preparation of the table of the temperature and the detected current of wet type developer at the standard concentration with respect to wet type developer 7 in the first embodiment (refer to FIG. 11) is performed.

However, for each lot of concentrated developer at a factory, only detected current at the standard toner concentration and at the standard temperature is measured to be memorized on a memory device which is mounted on a cartridge.

Thereby, table preparation for each lot is simplified.

As described above, in the toner concentration adjusting system and the image forming apparatus of the embodiment according to this invention in which the toner concentration adjustment is conducted by detecting viscosity as a substitute characteristic of toner concentration to be compared with the first control target value corresponding to a predetermined standard toner concentration, and controlling supply of a concentrated developer and the like based on the comparison result while a concentrated developer and the like is supplied into wet type developer with which the first control target value has been set, the first control target value is corrected depending on the second control target value based on a viscosity characteristic with respect to a concentrated developer lot to be supplied in which the concentrated developer is diluted to the standard toner concentration and depending on the cumulative supply amount of the concentrated developer lot.

Thereby, even in the case of a concentrated developer of a different lot being additionally and gradually supplied, it is possible to accurately adjust toner concentration without being affected fluctuation due to difference in lot of a concentrated developer to be supplied and viscosity variation depending on a supply amount, that is, deviation of the detected result of the toner concentration. In addition, productivity is improved because of an increased adjustment range.

Here, the above-described embodiments are examples in all aspects and do not limit the present invention thereto. The scope of the present invention is presented not by the above-described explanation but by the appended claims, and it is intended that the present invention covers the modifications and variations of this invention as long as they come within the scope of the appended claims and their equivalents.

What is claimed is:

1. A toner concentration adjusting system, comprising:

a toner concentration adjusting tank configured to store a first wet type developer containing toner and dispersion medium;

a concentration detecting section configured to measure a first control value corresponding to viscosity which is a substitute characteristic of toner concentration of the first wet type developer in the toner concentration adjusting tank;

a concentrated developer supply section configured to supply the toner concentration adjusting tank with a concentrated developer having a toner concentration higher than a predetermined standard toner concentration;

a dispersion medium supply section configured to supply the toner concentration adjusting tank with dispersion medium;

a supply control section configured to control the concentrated developer supply section and the dispersion medium supply section so that the first control value measured by the concentration detecting section gets close to a first control target value corresponding to viscosity which is a substitute characteristic of toner concentration of the wet type developer with the standard toner concentration, the supply control section including:

a supply amount measuring section configured to measure a cumulative supply amount of the concentrated developer; and a control target value correction section configured to correct the first control target value based on a second control target value corresponding to viscosity which is a substitute characteristic of toner concentration of a diluted developer in which the concentrated developer is diluted to the standard toner concentration with the dispersion medium, and based on the cumulative supply amount measured by the supply amount measuring section.

2. The toner concentration adjusting system of claim 1, wherein the concentration detecting section includes:

a stirring member configured to stir the first wet type developer in the toner concentration adjusting tank; and a motor configured to rotate the stirring member, wherein the concentration detecting section measures the first control value, corresponding to the viscosity of the first wet type developer, by measuring a current of the motor corresponding to a torque of the motor when stirring the first wet developer.

3. The toner concentration adjusting system of claim 1, comprising:

a concentrated developer tank for storing the concentrated developer; and a concentrated developer concentration detecting section configured to measure a second control value corresponding to viscosity which is a substitute characteristic of toner concentration of the concentrated developer when the concentrated developer is newly stored in the concentrated developer tank, wherein the supply control section calculates, based on the second control value measured by the concentrated developer concentration detecting section, the second control target value corresponding to the viscosity of the diluted developer with the standard toner concentration.

4. The toner concentration adjusting system of claim 1, wherein the supply control section controls the concentrated developer supply section and the dispersion medium supply section so as to supply the concentrated developer and the dispersion medium to the toner concentration adjusting tank at a predetermined ratio thereby diluting the concentrated developer in the toner concentration adjusting tank, and calculates the second control target value corresponding to the viscosity of the diluted developer with the standard toner concentration based on a measured value, measured by the concentration detecting section, corresponding to viscosity of the diluted developer in the toner concentration adjusting tank.

5. The toner concentration adjusting system of claim 1, wherein the supply control section reads, from a storage device mounted on a container containing the concentrated developer, the second control target value stored in the storage device at a time of shipping from a factory, the second control target value corresponding to the viscosity of the diluted developer in which the concentrated developer is diluted to the standard toner concentration.

6. An image forming apparatus, comprising:

an image carrier configured to carry thereon an electrostatic latent image;

a toner concentration adjusting system, the toner concentration adjusting system including:

a toner concentration adjusting tank configured to store a first wet type developer containing toner and dispersion medium;

a concentration detecting section configured to measure a first control value corresponding to viscosity which is a substitute characteristic of toner concentration of the first wet type developer in the toner concentration adjusting tank;

a concentrated developer supply section configured to supply the toner concentration adjusting tank with a concentrated developer having a toner concentration higher than a predetermined standard toner concentration;

a dispersion medium supply section configured to supply the toner concentration adjusting tank with dispersion medium; and a supply control section configured to control the concentrated developer supply section and the dispersion medium supply section so that the first control value measured by the concentration detecting section gets close to a first control target value corresponding to viscosity which is a substitute characteristic of toner concentration of the wet type developer with the standard toner concentration, the supply control section having:

a supply amount measuring section configured to measure a cumulative supply amount of the concentrated developer; and a control target value correction section configured to correct the first control target value based on a second control target value corresponding to viscosity which is a substitute characteristic of toner concentration of a diluted developer in which the concentrated developer is diluted to the standard toner concentration with the dispersion medium, and based on the cumulative supply amount measured by the supply amount measuring section; and a wet type development device configured to develop the electrostatic latent image on the image carrier with the wet type developer, containing toner and dispersion medium, supplied from the toner concentration adjusting tank.

* * * * *